United States Patent [19]

Zeller et al.

[11] Patent Number: 4,689,744

[45] Date of Patent: Aug. 25, 1987

[54] CONTROL METHOD FOR A RECORDING DEVICE

[75] Inventors: Vincent P. Zeller; Wesley J. Burris, II, both of Duncan, Okla.

[73] Assignee: Halliburton Company, Duncan, Okla.

[21] Appl. No.: 691,254

[22] Filed: Jan. 14, 1985

[51] Int. Cl.[4] ..... G01V 1/40; G04F 10/00

[52] U.S. Cl. ..... 364/422; 73/151; 73/151.5; 367/25; 364/569

[58] Field of Search ..... 367/33, 78, 79, 25; 364/422, 178, 179, 569; 73/151, 151.5, 152; 340/347 SH

[56] References Cited

U.S. PATENT DOCUMENTS

| | | | |
|---|---|---|---|
| 4,195,349 | 3/1980 | Balkanli | 73/152 |
| 4,456,959 | 6/1984 | Hirano et al. | 364/569 |
| 4,538,248 | 8/1985 | Lehardt | 367/25 |
| 4,558,422 | 12/1985 | Denbeste et al. | 364/179 |
| 4,564,918 | 1/1986 | McNally et al. | 364/569 |

*Primary Examiner*—Jerry Smith
*Assistant Examiner*—Kimthanh Tbui
*Attorney, Agent, or Firm*—Joseph A. Walkowski; E. Harrison Gilbert, III

[57] ABSTRACT

A preferred embodiment of a method for developing a single set of time intervals for controlling a memory device effectively utilizes a histograph having two parallel time lines with the same scale. One time line has a series of minimum time periods, each corresponding to when a respective event might occur. The other time line has a series of maximum time periods during which the respective events might occur. Time segments are defined between corresponding minimum and maximum time periods and sample rates and ratios are assigned to each time segment. At each start and end time of a period, the possible sample rates needed at that time are compared and the fastest sample rate is selected. The ratios are similarly analyzed, and the minimum ratio is selected. Consecutively occurring sample rates having the sample value are grouped into respective time intervals. The resulting time intervals, sample rates and ratios are entered into an electronic memory device which thereafter operates to obtain the desired information at the selected ratios and sample rates during the respective time intervals.

20 Claims, 11 Drawing Figures

CONTROL METHOD FOR A RECORDING DEVICE

BACKGROUND OF THE INVENTION

This invention relates generally to a method of programming, with at least a series of time intervals and a series of sample rates, a means for recording at least one detected phenomenon occurring during a series of events. More particularly, but not by way of limitation, the present invention relates to a method of recording in an electronic memory device pressure and temperature detected during a plurality of events which occur in a well.

It is, of course, known that there is a need for methods for recording phenomena during various events. For example, pressure and temperature in a downhole environment often need to be recorded during alternately flowing and non-flowing (closed-in) periods during the testing of an oil or gas well.

In the specific example of the testing of an oil or gas well, it is known that a Bourdon tube device can be used to mechanically record pressure and temperature by creating a scribed metallic chart containing a line representing the detected phenomenon, such as pressure. The Bourdon tube device has at least two shortcomings in that it has a limited data recording capacity and a limited programability.

As an alternative to the Bourdon tube type of recording device, electronic memory gauges have been used to electronically record pressure and temperature in electrical digital form. In the specific example of data recordation during the testing of an oil or gas well, various electronic memory gauges have been manufactured or marketed by such companies as Geophysical Research Corporation, Sperry Corporation, and Panex Corporation. These devices have used electronic memories for receiving digital data derived from transducers which are responsive to pressure or temperature.

The types of such electronic memory gauges known to us have a shortcoming in that they can only be programmed to sample pressure and temperature, for example, at one set of contiguous time intervals. Although the interval lengths can be varied within predetermined ranges, only one set of time intervals can be programmed into the electronic memory gauges at one time. Heretofore, this one set of time intervals has corresponded to a single set of time period at which the events have been anticipated to likely occur. For example, if it were desired to record pressure and temperature in a well during two different events, such as a flowing period and a closed-in period, one such electronic memory gauge would be programmed with a first estimated time interval during which it was anticipated that the flowing event would occur and with a second estimated time interval during which it was anticipated that the closed-in event would occur. Because the pressure and temperature are generally to be recorded at different rates during different events, one sample rate would be entered for the first time interval and another sample rate would be entered for the second time interval. This presents a problem in that if the actual times of the flowing and closed-in events are not correctly estimated by the selected time intervals, the rates at which the pressure and temperature will be sampled during the respective time intervals will not correctly correspond to the desired sample rate for the event that is actually occurring.

By way of a more specific example, assume that it will take six hours to run a testing string containing the memory gauge into the well borehole. During this event of running into the hole, the sample rate for recording the phenomena (e.g., the pressure and temperature) is to be 10 minutes. Assume that the next event is a first flow period which is to be completed within 30 minutes following the running of the testing string into the hole. During this interval, the sample rate is to be 3 minutes. Subsequent events, with their estimated time of completion and their desired sample rates shown in parentheses, include a first closed-in period (1 hour, with a sample rate of 15 seconds), a second flow period (1 hour, with a 3 minute sample rate), a second closed-in period (2 hours, with a 15 second sample rate for the first hour and a 1 minute sample rate for the second hour), and pulling out of the hole (6 hours, with a 10 minute sample rate). If any of the foregoing anticipated time schedules, which have been entered into the memory gauge as known to the art, is not precisely met by what actually occurs (as is the case in nearly every well test), it can be readily understood from the foregoing that such a difference between the actual and estimated times for the events will most likely cause the detected phenomena during subsequent events to be sampled at a rate which is different from the desired rate for the specific event. For example, if it actually took 7 hours to run into the hole, rather than the estimated 6 hours with which the aforementioned gauge was programmed, the memory gauge would be taking 15-second samples during the actual first flow event rather than the desired 3-minute samples. Assuming the actual first flow event lasted the estimated 30 minutes, then during the subsequent actual first closed-in period the gauge would be taking samples at the 3-minute sample rate which was programmed to commence at 7.5 hours from the starting time. During the actual first closed-in period, the gauge would not be gathering the quantity of information that was desired.

Therefore, there is the need for a method by which a recording means, such as an electronic memory gauge used for recording pressure and temperature in an oil or gas well, can be programmed to record the detected phenomena so that the desired quantity of data is less likely to be lost due to a difference between the estimated time at which an event is anticipated to occur and the actual time at which the event occurs. It is also desirable that such a new method be capable of use with a specific presently known memory device which can ultimately receive only a single set of time intervals. There is also the need for such a method to be capable of selecting a sample rate and a sample ratio for each time interval.

SUMMARY OF THE INVENTION

The method of the present invention meets the foregoing needs by, in effect, generating a single set of time intervals from two different sets of time periods. Broadly, the present invention functions by creating two time lines with different periods assigned to respective events during which phenomena are to be recorded and combining these into a single set of time intervals, which set is entered into the memory device. The method of the present invention selects one of possibly a plurality of sample rates for each time interval. In the preferred embodiment of the inventive method, the fastest sample rate is selected so that the chance of data loss is eliminated or at least reduced. Furthermore, the preferred embodiment method of the present invention permits ratios of the sampling of one phenomenon relative to another to be entered and used in recording the desired information. Therefore, through the use of the method of the present invention, a better time estimate and a better selection of sample rates and ratios are achieved than could be achieved by simply loading the prior art memory devices with a single initial estimate of times and sample rates.

With respect to a particular method of recording in an electronic memory device pressure and temperature detected during a plurality of events occurring in a well, the method comprises defining a plurality of first time periods, each of the first time periods representing a first period of time during which one of the events might occur, and defining a plurality of second time periods, each of the second time periods representing a second period of time during which one of the events might occur. This method also includes assigning a sample rate to each of the first time periods and each of the second time periods corresponding to the same one of the events so that a plurality of sample rates is defined in correspondence with the plurality of events. Each of the sample rates defines the frequency at which at least one of the pressure and temperature is to be recorded during the respective time periods. The inventive method also includes deriving from the plurality of first time periods, the plurality of second time periods, and the plurality of sample rates a single set of time intervals having a respective sample rate associated with each one of the time intervals. The method also comprises entering the single set of time intervals and each associated respective sample rate in the electronic memory device, activating the electronic memory device, lowering the electronic memory device into the well, and recording at least one of the pressure and temperature in response to the respective sample rate within each of the time intervals. In the preferred embodiment, the method further comprises assigning a pressure-to-temperature sample ratio to each of the first time periods and each of the second time periods corresponding to the same one of the events so that a plurality of pressure-to-temperature sample ratios is defined in correspondence with the plurality of events. This preferred embodiment also comprises associating a respective one of the plurality of pressure-to-temperature sample ratios with each one of the time intervals and entering each respective one of the pressure-to-temperature sample ratios associated with a time interval in the electronic memory device. In this preferred embodiment, the aforementioned step of recording includes recording the pressure and temperature at the respective sample rate and in the respective pressure-to-temperature sample ratio within each of the time intervals.

The aforementioned step of deriving the single set of time intervals includes, for at least one selected time within each of the first time periods and the second time periods, comparing all of the sample rates for those of the plurality of events which could be occurring at the selected time and selecting the fastest one of the compared sample rates. This deriving step further comprises grouping consecutively occurring ones of the selected sample rates having the sample value to define one of the time intervals for each group of the consecutively occurring, same-valued sample rates.

Therefore, from the foregoing, it is a general object of the present invention to provide a novel and improved control method for a recording device.

Other and further objects, features and advantages of the present invention will be readily apparent to those skilled in the art when the following description of the preferred embodiment is read in conjunction with the accompanying drawings.

BRIEF DESCRIPTION OF THE DRAWINGS

FIGS. 2A–2G depict a flow chart of a program for programming the computer shown in FIG. 1.

DETAILED DESCRIPTION OF THE PREFERRED EMBODIMENT

The following description of the method of the present invention will be described with reference to a specific usage wherein pressure and temperature are to be recorded during a drill stem test conducted in a borehole of a well. Apparatus for conducting such a test are schematically illustrated in FIG. 1.

Figure 1:
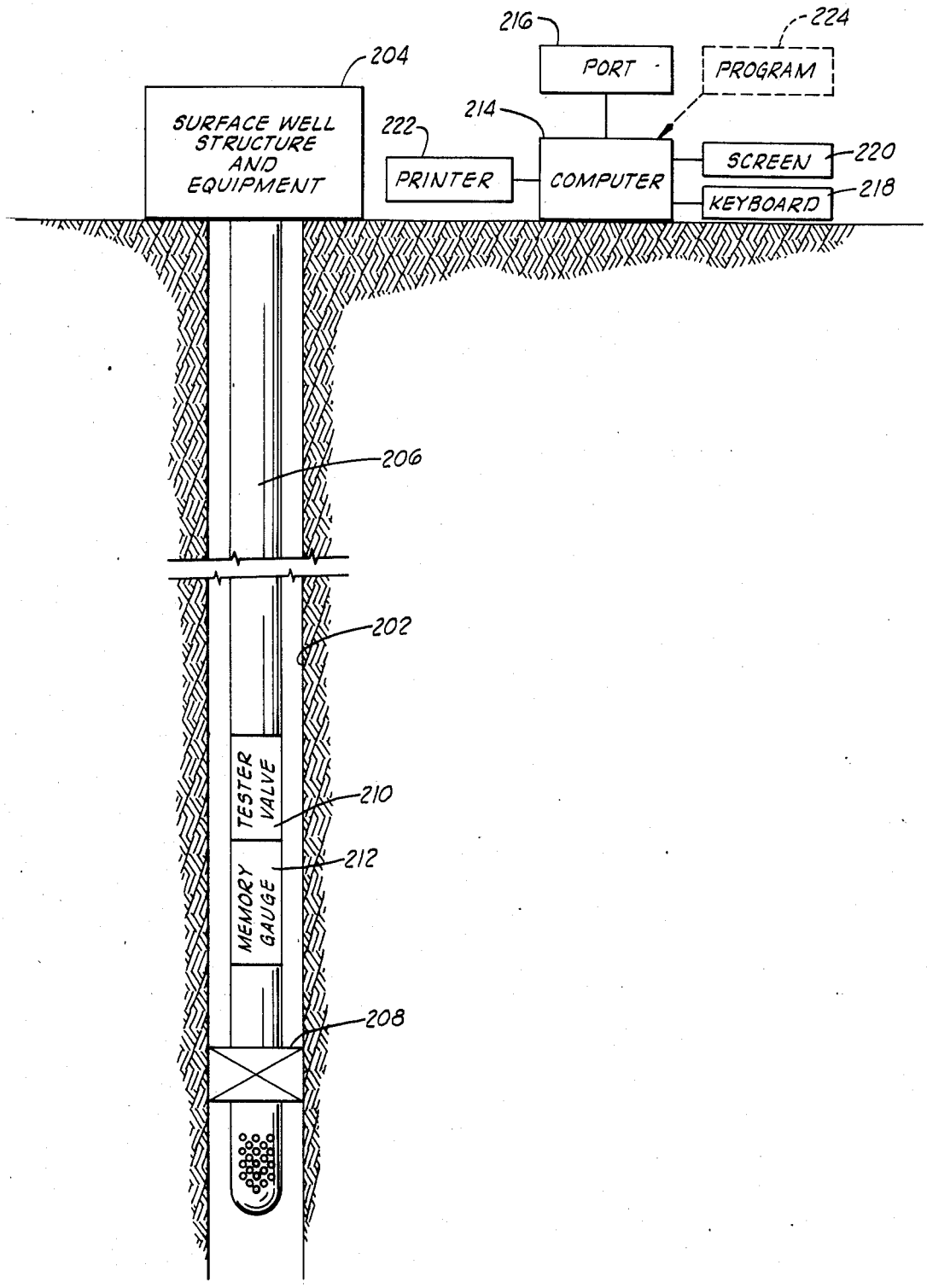
FIG. 1 is a schematic diagram showing a testing string, including an electronic memory gauge and a tester valve, disposed in the borehole of a well and also showing a computer system located at the surface.
Figure 2A:
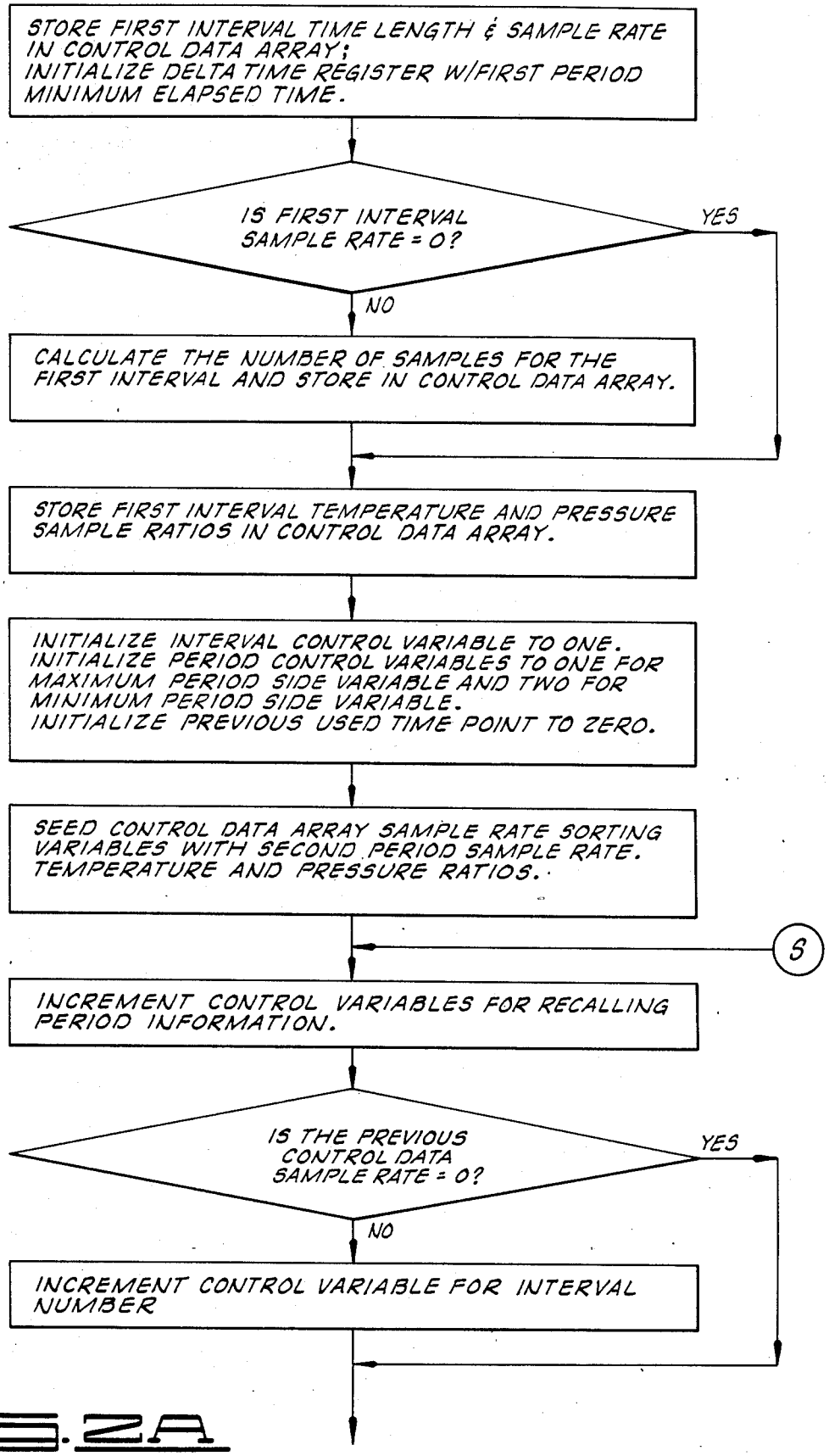
Figure 2B:
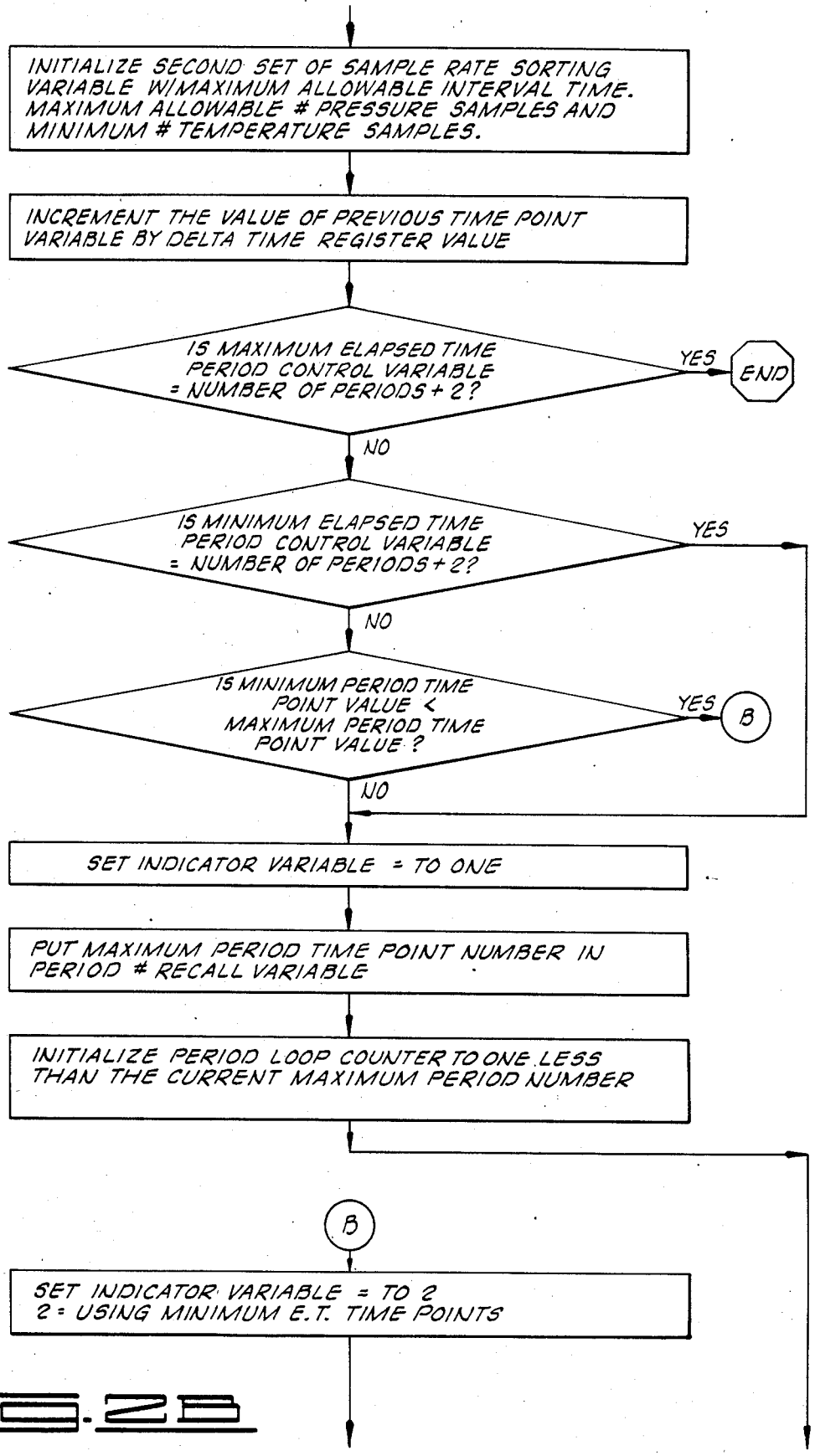
Figure 2C:
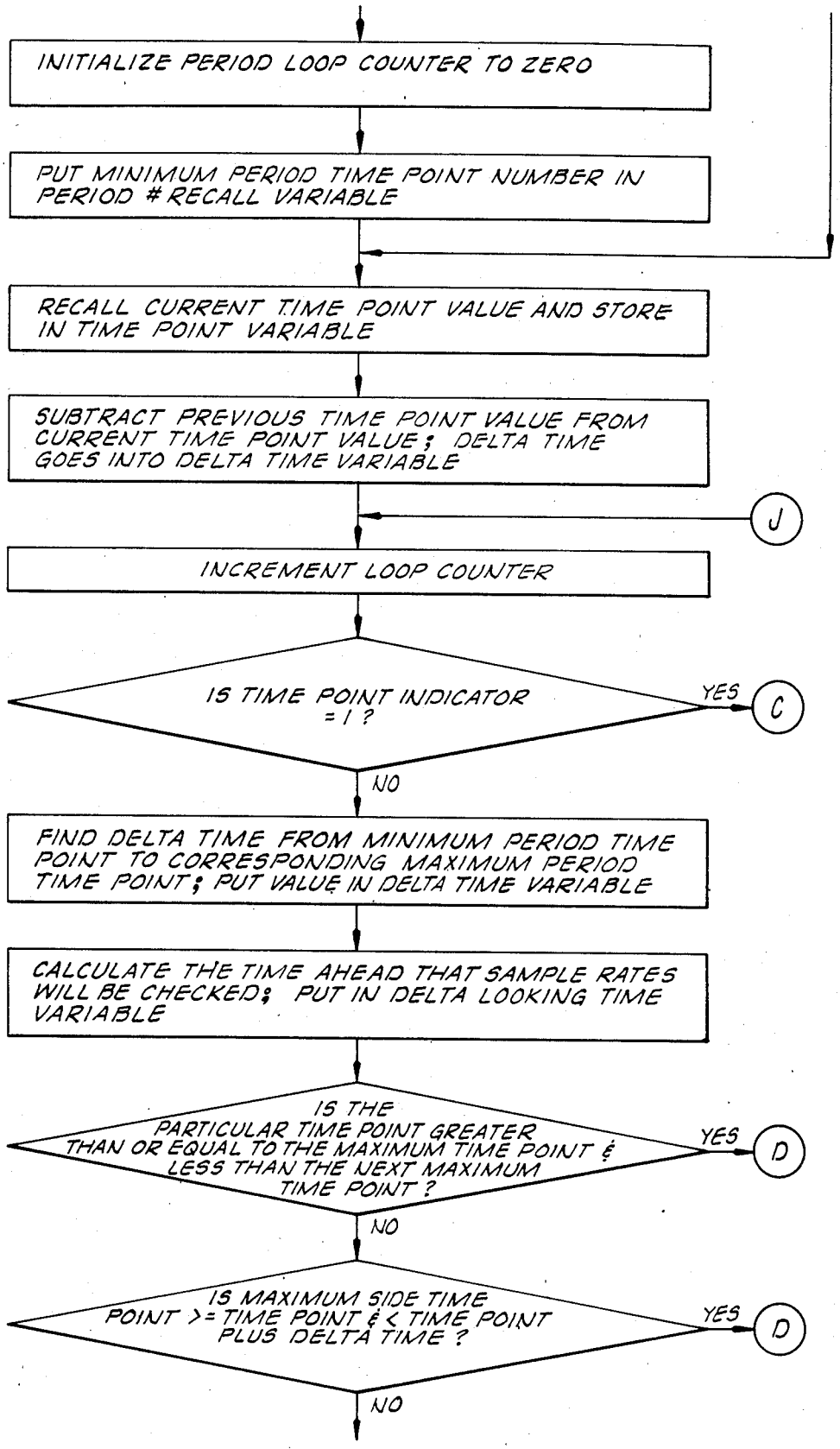
Figure 20:
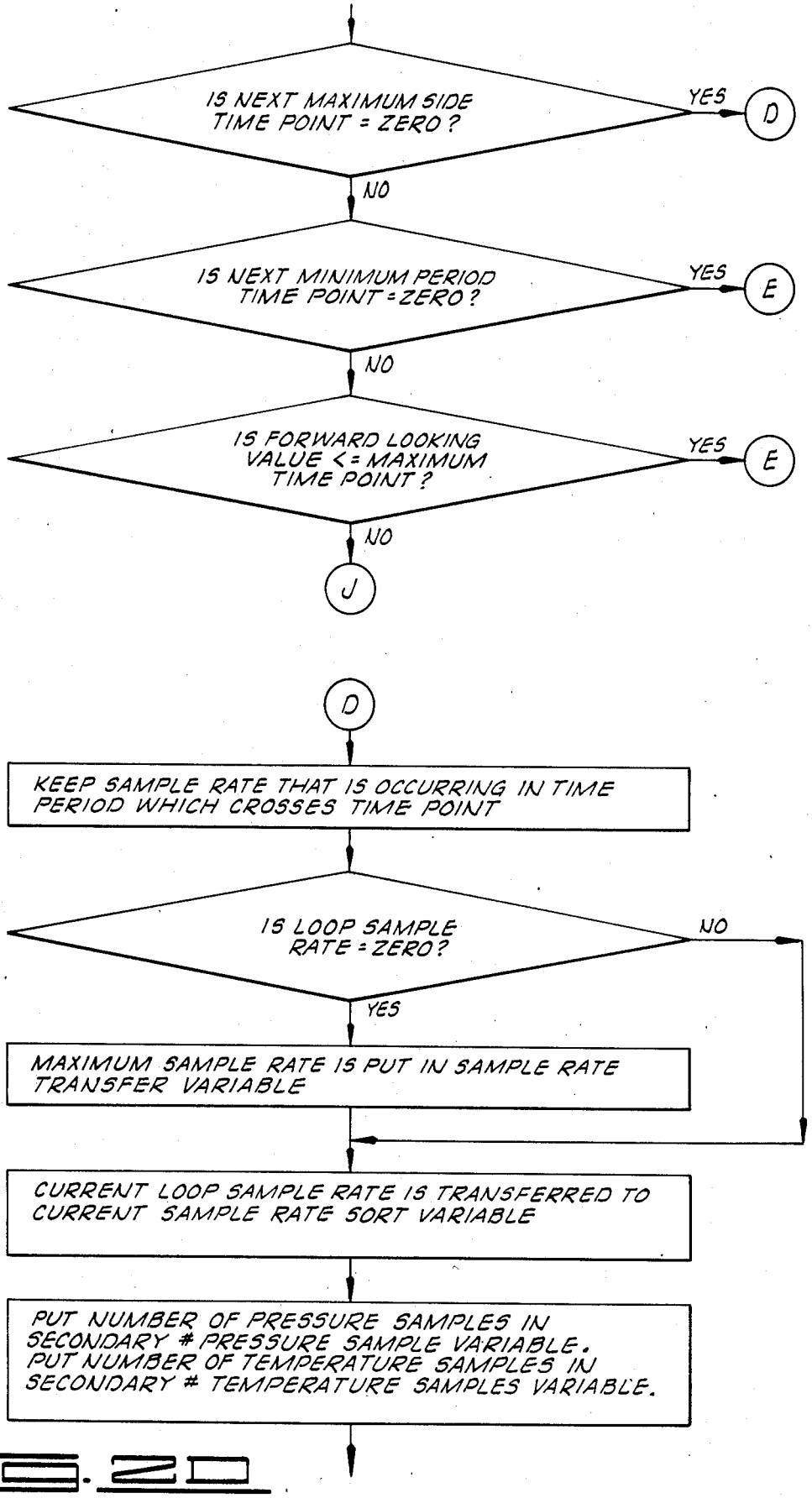
Figure 2E:
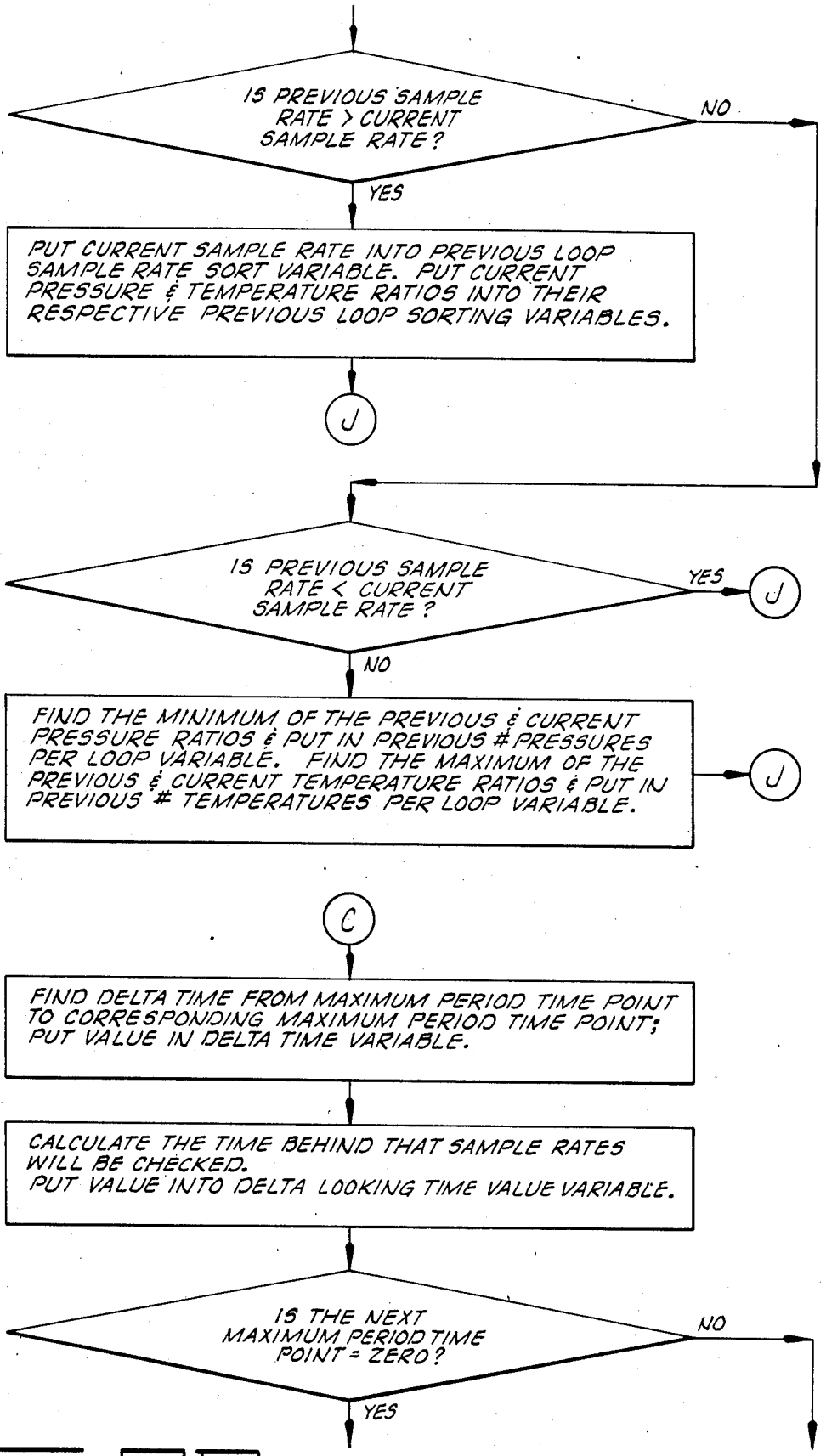
Figure 2F:
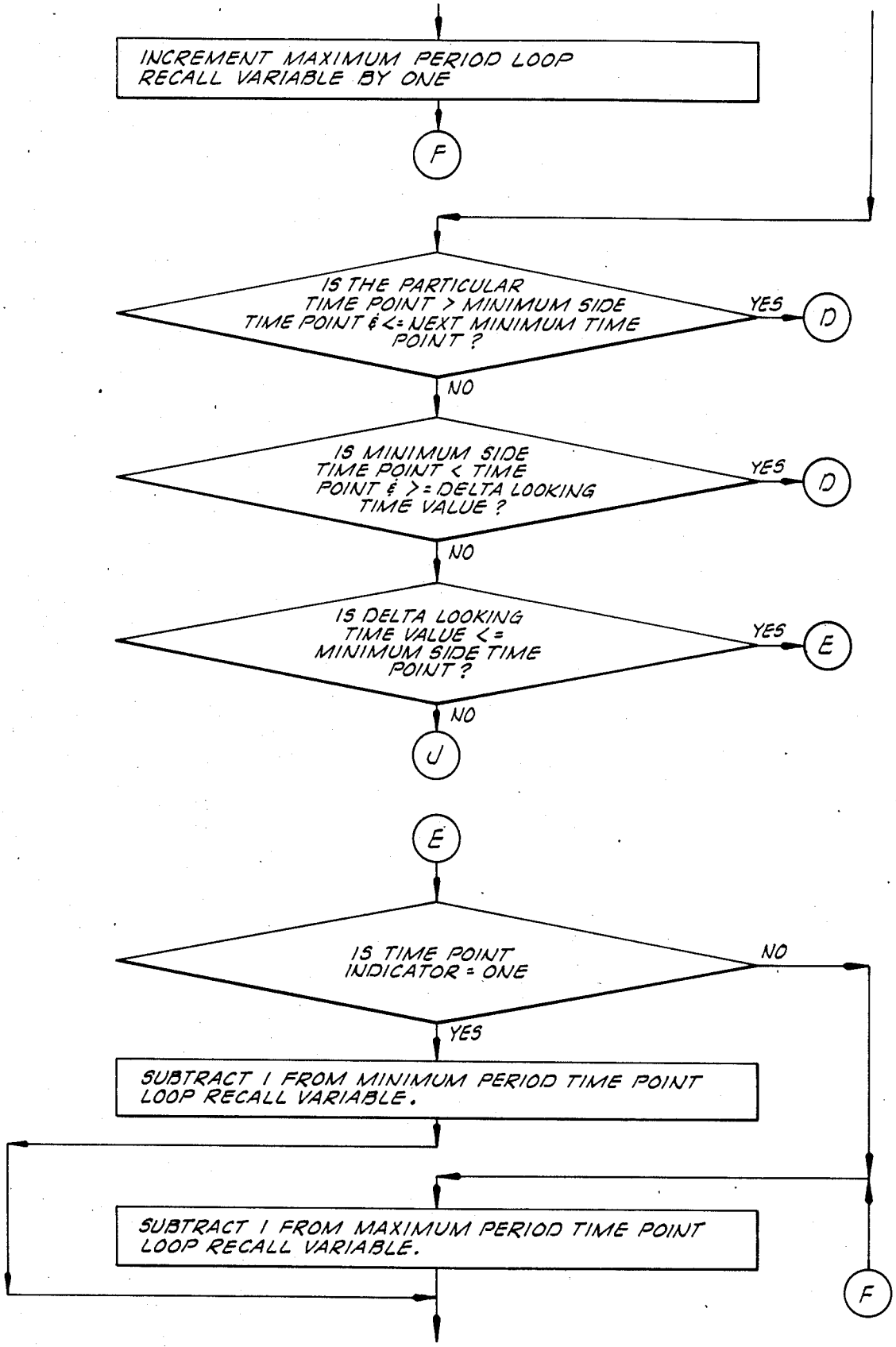
Figure 2G:
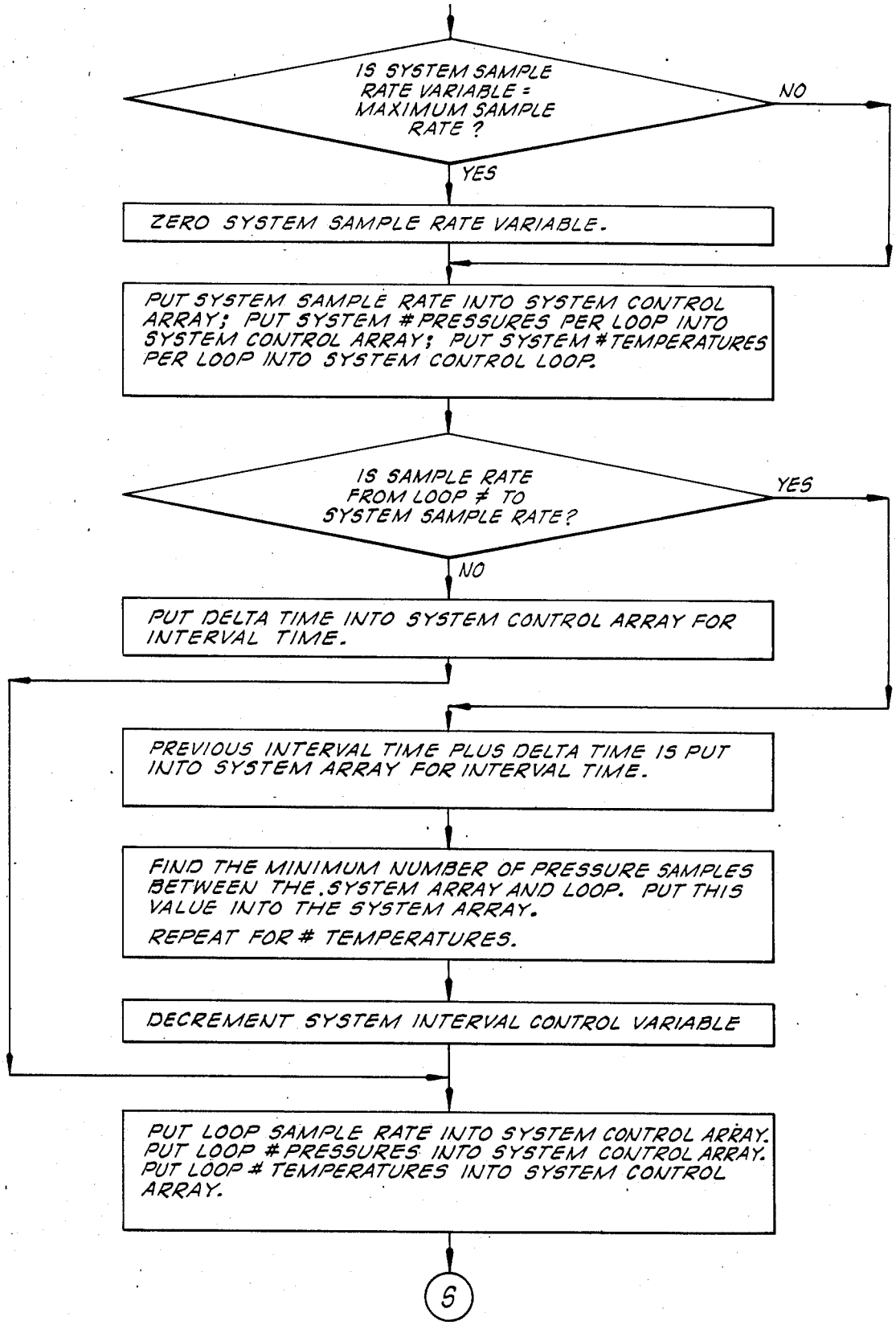

In FIG. 1, a well borehole 202 having a surface well structure and equipment assembly 204 of a type as known to the art located at the mouth of the borehole 202 are schematically depicted. Extending into the borehole 202 from the surface well structure and equipment assembly 204 is a testing tool string 206 shown associated with a packer 208 of a type as known to the art. The testing string 206 has a tester valve 210 of a type as known to the art and a memory gauge 212 of a type as known to the art contained therein. The electronic memory gauge 212 includes pressure and temperature transducers, electronic recording and control sections, and a battery power supply of types as known to the art. For example, the electronic recording and control section of the memory gauge 212 can be a Geophysical Research Corporation Model EMR 502 electronic recording and control section including a data storage means having the known capability of receiving up to twenty time intervals and of receiving a respective sample rate associated with each time interval. This device detects pressure and temperature through its pressure and temperature transducers and records, in digital format, the detected information at the respective sample rate during each respective one of the up to twenty time intervals.

Located at the surface of the well borehole 202 is a computer 214 of a type as known to the art for analyzing the data recorded in the memory gauge 212. For example, a Hewlett-Packard computer of a type as known to the art to be used at a well site for receiving and analyzing the data from the electronic memory gauge 212 can be used. The computer 214 receives the information from the memory gauge 212 through a suitable input/output port 216 of a type as known to the art. Data can be output through the input/output port 216.

Attached to the computer 214 for allowing an operator to control the operation thereof are a keyboard 218 and a video screen 220 of types as known to the art. To provide a hard copy output, there is also shown in FIG. 1 a printer 222 of a suitable type as known to the art.

In performing the method of the present invention, the computer 214 is programmed with an application program 224. The application program 224 is entered into the computer by any suitable means known to the art, such as from a program storage disc. The preferred embodiment of the application program 224 of the present invention is set forth in the program listing found at the end of this written description. The portion of the program listing from line 1298 through line 1388 is shown in the flow chart set forth in FIGS. 2A–2G. Because the program listing and the flow chart are self-explanatory to at least those having ordinary skill in the pertinent arts, the operation of the application program 224 will be described by way of example and with reference to a histograph 226 shown in FIG. 3. The term "histograph" is the term we have used to mean a graphical presentation of minimum and maximum times required to perform a series of events. The basic form of a histograph is two time lines plotted parallel to one another using the same scale. Along one time line a minimum sequence of events is shown at the times at which they are anticipated to occur, and along the other time line a maximum anticipated sequence of events is shown. Other information such as will be subsequently described can be shown on a histograph.

Figure 3:
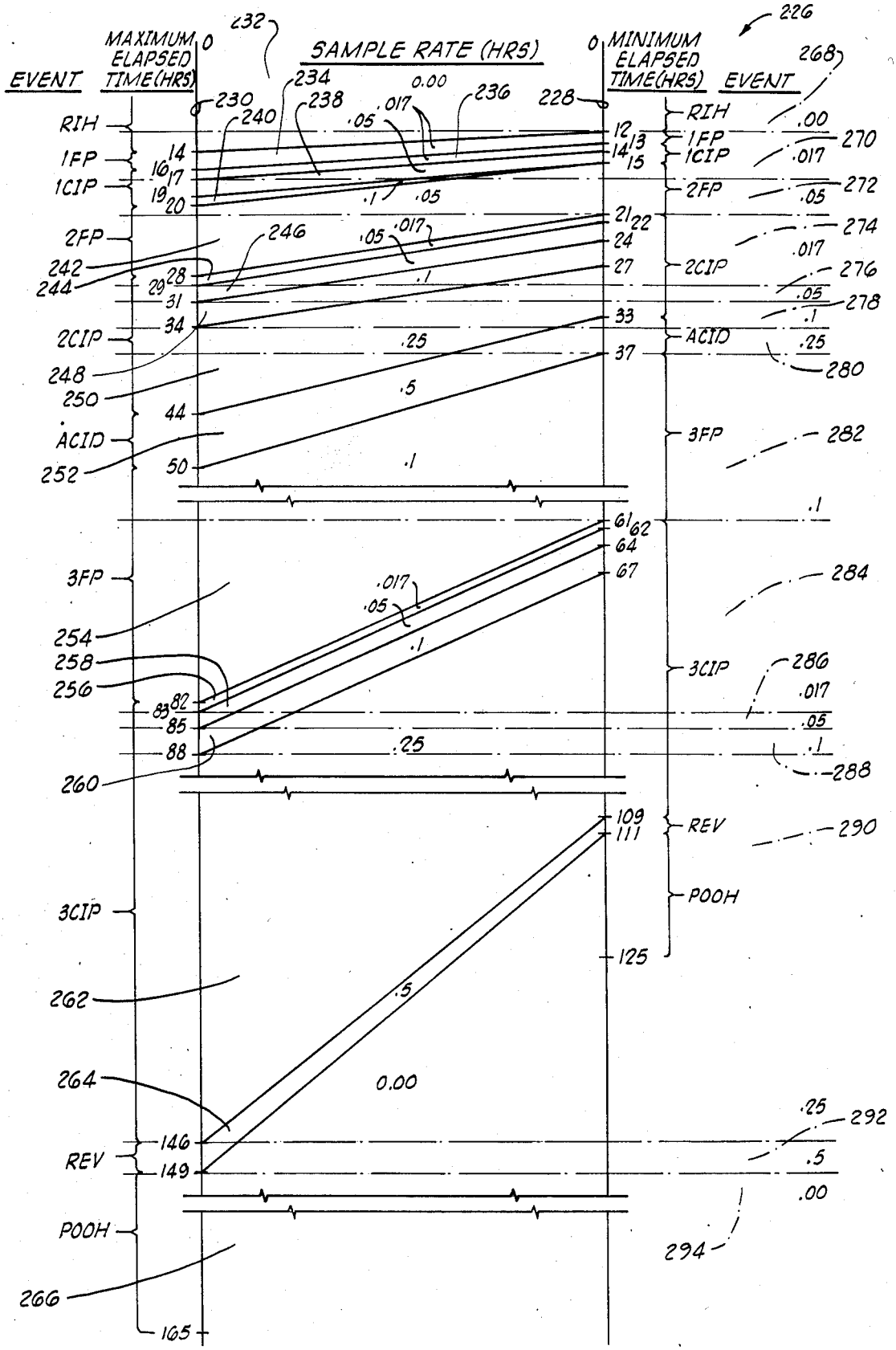
FIG. 3 is a histograph of minimum and maximum time lines having time periods, time segments, time intervals, sample rates and events shown thereon.

With reference to FIG. 3, the histograph 226 will be used to describe the preferred embodiment method of the present invention. Initially, however, the structure of the specific histograph 226 will be described.

The histograph 226 includes a first time line 228 and a second time line 230, each having the same scale and commencing at the same starting point, which starting point in the preferred embodiment of FIG. 3 is designated by the numeral "0." The time line 228 is marked with times defining minimum time periods representing anticipated initial periods during which events might occur. Specifically, the event of running in the hole ("RIH") is designated as likely to occur within the minimum time period between 0 and 12 hours. The other events and their anticipated minimum or initial periods are specified in the following table:

| Event | Length of Time (hrs.) | Minimum Time Period at which Event is Anticipated to Occur (Absolute Time from Starting Time - Hrs.) |
|---|---|---|
| first flow period (1FP) | 1 | 12–13 |
| first closed-in period (1CIP) | 1 (first sub-period) | 13–14 |
| | 1 (second sub-period) | 14–15 |
| | 0 (third sub-period) | 15–15 |
| second flow period (2FP) | 6 | 15–21 |
| second closed-in period (2CIP) | 1 (first sub-period) | 21–22 |
| | 2 (second sub-period) | 22–24 |
| | 3 (third sub-period) | 24–27 |
| | 6 (fourth sub-period) | 27–33 |
| acidizing (ACID) | 4 | 33–37 |
| third flow period (3FP) | 24 | 37–61 |
| third closed-in period (3CIP) | 1 (first sub-period) | 61–62 |
| | 2 (second sub-period) | 62–64 |
| | 3 (third sub-period) | 64–67 |
| | 42 (fourth sub-period) | 67–109 |
| reverse circulation (REV) | 2 | 109–111 |
| pull out of hole (POOH) | 14 | 111–125 |

The foregoing minimum time periods are selected prior to a well test based on anticipated job requirements. In the illustrated preferred embodiment, these job requirements indicate that each time period is contiguous with each immediately preceding and each immediately succeeding event, if any. For example, the event of running in the hole is immediately succeeded by the first flow period which is immediately succeeded by the first closed-in period and so on. These contiguous time periods, therefore, have common, or coincident, end and start times. For example, the first flow period is defined between 12 and 13 hours whereas the first closed-in period is defined between 13 and 15 hours so that the time of 13 hours specifies the end time for the estimated minimum first flow period and the start time for the estimated minimum first closed-in period. Similarly, the time of 15 hours defines the end time of the estimated minimum first closed-in period and it defines the start time of the estimated minimum second flow period.

The time line 230 is demarcated by times and events in a manner similar to the time line 228 except that the time of the time line 230 define anticipated final or maximum periods during which the events are anticipated to occur. The events, their anticipated lengths and resultant anticipated time periods are specified in the following table:

| Event | Length of Time (hrs.) | Maximum Time Period at which Event is Anticipated to Occur (Absolute Time from Starting Time–Hrs.) |
|---|---|---|
| running in hole (RIH) | 14 | 0–14 |
| first flow period (1FP) | 2 | 14–16 |
| first closed-in period (1CIP) | 1 (first sub-period) | 16–17 |

-continued

| Event | Length of Time (hrs.) | Maximum Time Period at which Event is Anticipated to Occur (Absolute Time from Starting Time-Hrs.) |
|---|---|---|
| | 2 (second sub-period) | 17–19 |
| | 1 (third subperiod) | 19–20 |
| second flow period (2FP) | 8 | 20–28 |
| second closed-in period (2CIP) | 1 (first sub-period) | 28–29 |
| | 2 (second sub-period) | 29–31 |
| | 3 (third sub-period) | 31–34 |
| | 10 (fourth sub-period) | 34–44 |
| acidizing (ACID) | 6 | 44–50 |
| third flow period (3FP) | 32 | 50–82 |
| third closed-in period (3CIP) | 1 (first sub-period) | 82–83 |
| | 2 (second sub-period) | 83–85 |
| | 3 (third sub-period) | 85–88 |
| | 58 (fourth sub-period) | 88–146 |
| reverse circulation (REV) | 3 | 146–149 |
| pull out of hole (POOH) | 16 | 149–165 |

In the preferred embodiment, the events along the maximum time line 230 are also contiguous so that an end time of one time period is also a start time of the next adjacent time period. For example, the hour 16 is the end time for the estimated maximum first flow period and the start time for the estimated maximum first closed-in period. Therefore, when the time periods are contiguous as shown in FIG. 3, an end time of one time period coincides with a start time of the next time period.

FIG. 3 also shows solid diagonal lines connecting a start time for a minimum time period with a start time for a maximum time period and connecting an end time for a minimum time period with an end time for a corresponding maximum time period; "corresponding" here meaning associated with the same event. For example, the times of 12 and 14 hours correspond, respectively, to the start of the minimum first flow period and the start of the maximum first flow period. The time of 13 hours is connected to the time of 16 hours because they represent the corresponding ends of the minimum time period and the maximum time period associated with the first flow period event. This demarcation defines time segments associated with each event. That is, there is a time segment 232 associated with the event of running in the hole. This segment is bounded by the common start time of both the minimum time line 228 and the maximum time line 230 and by the diagonal connecting the respective end times at 12 and 14 hours. A time segment 234 is defined in association with the first flow period. The first closed-in period has three time segments 236, 238, 240 associated with respective ones of the first, second and third sub-periods of the first closed-in period. The 15–21 minimum time period and the 20–28 maximum time period, and the associated interconnecting diagonal lines, define a time segment 242 for the second flow period. The second closed-in period includes time segments 244, 246, 248, 250. The acidizing period has a time segment 252 whereas the third flow period has a time segment 254. The third closed-in period includes time segments 256, 258, 260, 262 respectively corresponding to the first, second, third and fourth sub-periods of the third closed-in period. The reverse circulation event has a time segment 264 and the pulling out of the hole event has a time segment 266.

Assigned to each time segment is a respective sample rate which defines the frequency at which a selected phenomenon, such as the exemplary pressure or temperature, is to be recorded during the respective time segment. For example, during the time segment 232 during which the running in the hole event is anticipated to occur, no samples need be taken. In the preferred embodiment of the present invention, a zero sample rate is an infinite sample rate because there is an infinite time between samples since no sample is taken. The time segment 234 has a sample rate of 0.017 hours, which is a rate for taking a sample approximately every 1 minute, 1.2 seconds. The time segment 238 has a 0.05 hour sample rate which translates to taking a sample every three minutes. The time segment 240 has a 0.1 hour sample rate which translates to one sample being taken every six minutes. The time segment 250 has a 0.25 hour or 15 minute sample rate, and the time segment 264 has a 0.5 hour or 30 minute sample rate. The remaining assignment of sample rates to time segments is shown in FIG. 3. The assignments are effectively made as to each time increment between and including the minimum start time and the maximum end time of the time segment.

Figure 4:
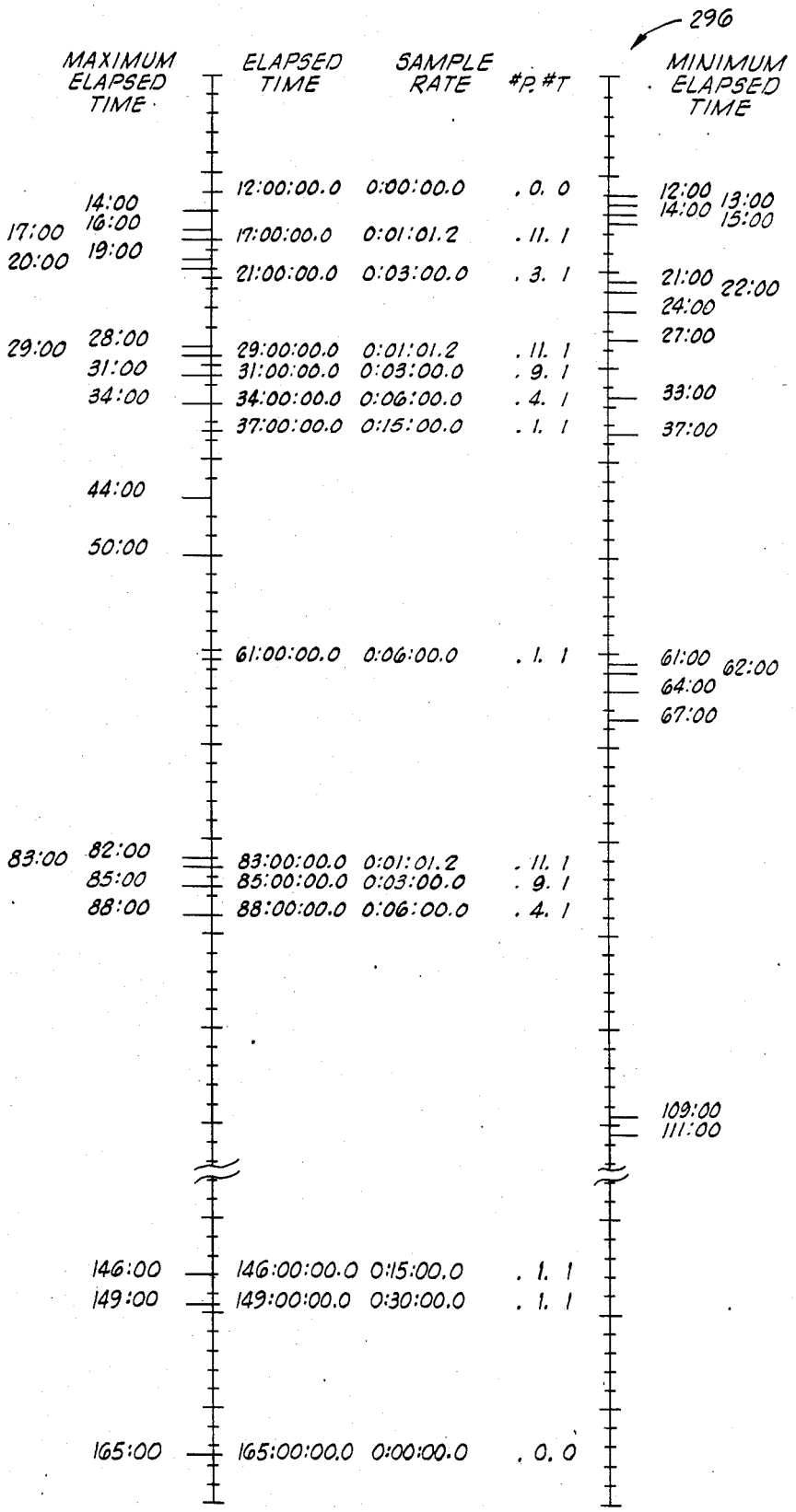
FIG. 4 is an illustration of a printout showing the derived time intervals in absolute time and with the associated sample rates and ratios.
Figure 5:
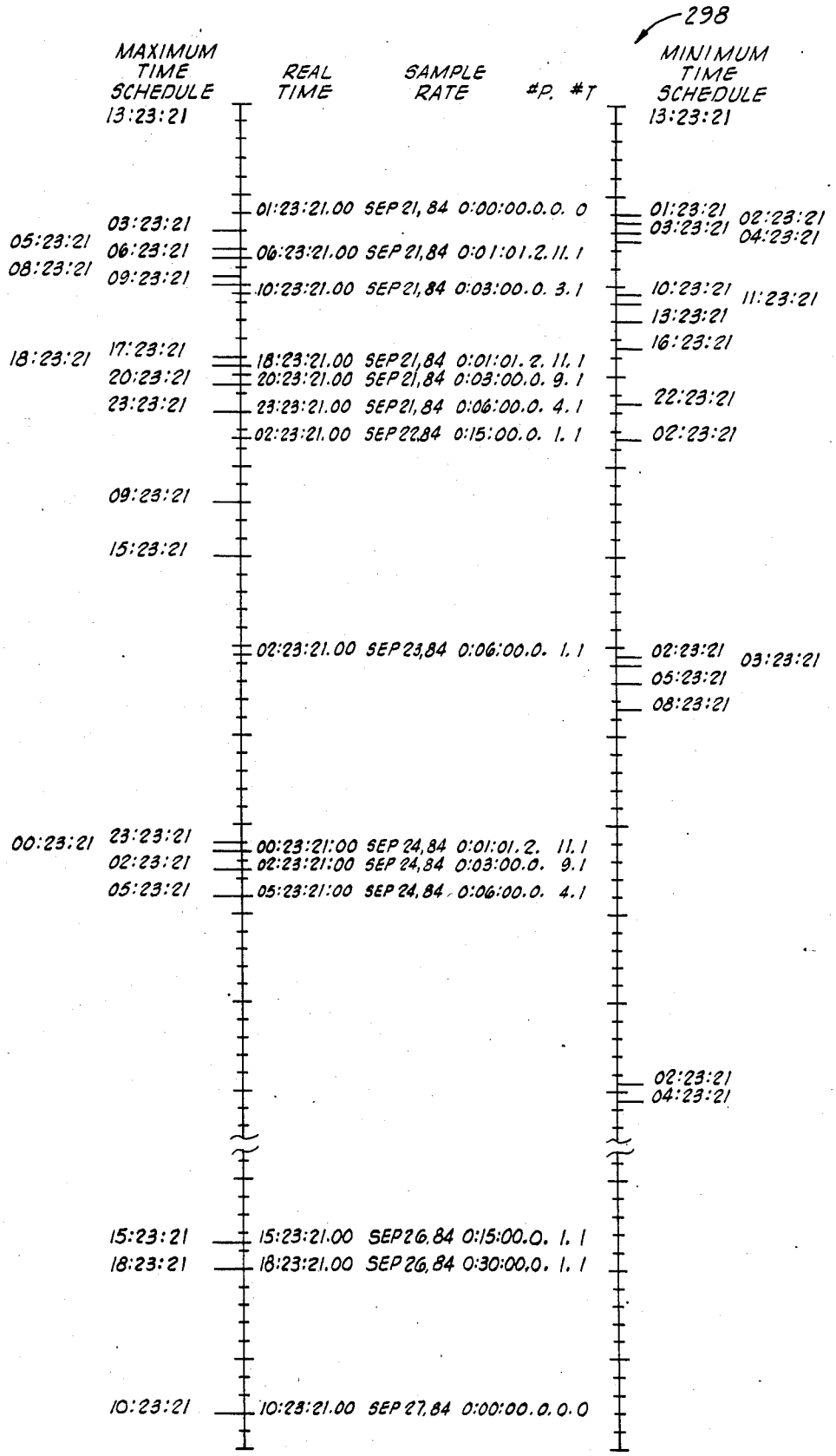
FIG. 5 is an illustration of a printout showing the derived time intervals in real time and with the associated sample rates and ratios.

Although not shown in FIG. 3, each time segment can also have a ratio entered when two or more phenomena are to be sampled. In our specific example wherein both pressure and temperature are to be sampled, a ratio of the number of pressure samples to be taken for each temperature sample can be entered. These ratios are not shown in FIG. 3 for purposes of simplifying the drawing. the resultant ratios derived from the utilization of the present method as will be more particularly described hereinbelow are shown in FIGS. 4 and 5, also to be described subsequently.

To effectively create the histograph shown in FIG. 3 and described herinabove, an operator of the computer 214, after having loaded the applications program 224 therein, converses with the computer 214 and the program 224 through the keyboard 218 and the video screen 220. In response to prompts displayed at the screen 220 through the operation of the program 224, the operator enters elapsed time information and sample rates and ratio information from which the computer can, in effect, construct the time lines 228, 230 and the time segments 232–266 and assign the sample rates and ratios to the respective time segments.

Once the time, sample rate and ratio information for the illustrated embodiment has been entered into the computer 214, the computer effectively creates the histograph as shown in FIG. 3 and derives therefrom a series of contiguous time intervals so that each of the time intervals includes at least a portion of at least one of the minimum or maximum time periods and so that each of the time intervals has associated therewith one of the sample rates and ratios associated with those portions of the minimum or maximum time periods included within the respective time interval. In the preferred embodiment, the fastest sample rate and the minimum ratio are selected. In the preferred embodiment, there are twenty or less time intervals created so that the time intervals generated can be loaded into the Geophysical Resources Corporation electronic memory gauge used in the exemplary specific embodiment.

To derive the time intervals, the program 224 controls the computer 214 so that the possible sample rates which could be needed at critical times are examined. In the preferred embodiment the "critical times" are at each start time and end time of both the minimum and maximum time periods. For example, 12 hours is shown in FIG. 3 to be the start time of the minimum time period of 12–13 hours defined for the first flow period (it is also the end time of the minimum running in hole time period of 0–12 hours). The computer 214, under control of the program 224, recognizes the hour 12 as a critical hour and so compares each possible sample rate which could be needed for each event which has been estimated to possibly occur at that time. From FIG. 3, the needed sample rate at 12 hours could be 0.00 if the running in hole event were still occurring (this event was estimated as possibly occurring for up to the first 14 hours), or the needed sample rate could be 0.017 if the first flow period event were commenced. The computer 214 compares these two sample rates and selects the faster one, which in this example is 0.017 because 0.00 represents an infinite sample period.

The computer 214 steps to the next critical start or end time, which is at the 13 hour mark in the illustrated embodiment. This time represents the end time of the minimum first flow period event and the start time of the first sub-period of the minimum first closed-in period event. At this time point, the computer 214 compares three numbers because at 13 hours the actual event could be the running in hole event (with a sample rate of 0.00) or the first flow period event (with a sample rate of 0.017) or the first sub-period of the first closed-in period event (with a sample rate of 0.017 ). The fastest rate is selected so that, again, 0.017 is the selected sample rate.

At the 14 hour mark, the next critical time for the specific histograph shown in FIG. 3, the computer 214 compares the assigned sample rates for the possible events that could be occurring at that time. The 14 hour time point is the end time of the first sub-period of the minimum first closed-in period event and the start time of the second sub-period of the minimum first closed-in period, and the 14 hour time point is also the end time of the maximum running in hole event and the start time for the maximum first flow period. Comparing the sample rates of these possible events again results in the 0.017 sample rate being selected as the fastest of the possible sample rates to be needed at 14 hours. A similar result is obtained when the analysis is made at both the 15 hour time point and the 16 hour time point.

FIG. 3 shows that the 17 hour time point is the end time for the first sub-period of the maximum first closed-in period event and it is also the start time for the second sub-period of the maximum first closed-in period event. At this 17 hour mark, the last possible rate needed is 0.017 for the time segment 236 ending at the 17 hour time point; but also at the 17 hour mark, the second sub-period of the first closed-in period could be occurring (designated by the time segment 238 which has a sample rate of 0.5 assigned thereto) or the third sub-period of the first closed-in period could be occurring (designated by the time segment 240 with an assigned sample rate of 0.1) or the second flow period could be occurring (designated by the time segment 242 with an assigned sample rate of 0.05). As with the previous time periods, these events are determined in FIG. 3 by reading straight across between the corresponding times on the maximum elapsed time line 230 and on the minimum elapsed time line 228, both of which time lines have the same scale, and by noting which time segments are crossed. In comparing these four possible events and their associated sample rates, the 0.017 sample rate is selected in the preferred embodiment since it is the fastest of the possible needed sample rates.

To determine the sample rate needed after the 17 hour mark, the next critical time of 19 hours must be examined. Since the 19 hour mark is on the maximum time line 230, it is examined just as the 17 hour mark was examined. That is, the sample rate for the period whose maximum end is defined at 19 hours (i.e., the rate for the time segment 238) and the sample rates for the periods which could be occurring at 19 hours (i.e., the rates for the time segments 240, 242) are compared to obtain the fastest one. For the rates shown in FIG. 3, this results in a needed sample rate of 0.05.

The computer 214, under control of the program 224, recognizes that, in accordance with the preceding description, prior to the 17 hour mark the needed sample rate is 0.017 and that prior to the 19 hour mark the needed sample rate is 0.05. Thus, the computer determines that the 17 hour mark needs to be the boundary between two adjacent time intervals, the former needing a sample rate of 0.017 and the latter needing a sample rate of 0.05. In response thereto, the computer 214 groups the previous 0.017 sample rates into one group which becomes a respective time interval. The computer 214 continues this process of examining the possible sample rates which might occur at the specified times along the minimum and maximum time lines 228, 230 and of grouping the consecutively occurring, same-valued sample rates into respective time intervals. For the specific illustration set forth in FIG. 3, the time intervals are designated by the horizontal dot-dash lines and the associated selected fastest sample rates are shown along the right-hand margin. The time intervals are identified by the reference numerals 268, 270, 272, 274, 276, 278, 280, 282, 284, 286, 288, 290, 292, 294.

In examining FIG. 3, it will be noted that each of the time intervals starts and ends at a respective one of the predetermined period start or end times along either the minimum time line 228 or the maximum time line 230. Each of these time intervals thus includes at least a portion of at least one of the minimum time periods or maximum time periods. For example, the time interval 280 extends from 34 hours to 37 hours, thereby including part of the minimum acidizing period defined between 33 and 37 hours and part of the fourth sub-period of the maximum second closed-in period defined between 34 and 44 hours.

The foregoing selection of the sample rates is performed by the portion of the program shown in the flow chart of FIGS. 2A–2G. Broadly, this program iterates or loops at each critical time until all the potential rates have been compared. When the critical time is on the minimum time line 228, the comparison is from the next possible future rate back to the last possible rate needed at that time. For example, at the 67 hour mark on the minimum time line 228 shown in FIG. 3, the program first compares the future rate of 0.25 for the time segment 262 to a predetermined "seed" value which is some maximum default sample rate preset in the program. This comparison results in 0.25 being selected. The program loops and next compares the 0.25 rate to the 0.1 rate for the time segment 260, representing the most recent past event measured relative to the critical point of 67 hours. This comparison results in the 0.1 rate being selected because it is a faster rate than 0.25. This looping, comparing and selecting continues until all possible events which could be occurring at the 67 hour mark have been checked. This means the comparison for the embodiment shown in FIG. 3 continues back through the rates of 0.05, 0.017 and 0.1 associated with the time segments 258, 256, 254, respectively. When the critical time is on the maximum time line 230, the comparison is performed from the last possible rate to the most future rate possibly needed at that time. For example, at the 82 hour time point on the maximum time line 230, the program first compares the past rate of 0.1 assigned to the time segment 254 with the seed value. The following comparisons then proceed, in order, through the sample rates assigned to the time segments 256, 258, 260, 262 which encompass events which it is estimated could occur at 82 hours.

When a respective ratio defining the number of samples of one phenomenon to be recorded relative to the number of samples of another detected phenomenon is assigned to each of the time segments 232–266, the computer 214, under control of the program 224, compares the possible ratios in a manner similar to how the possible sample rates are compared. In the preferred embodiment, the minimum ratio of those possible ratios needed at any one of the particular times is selected.

Once the time intervals, sample rates and ratios have been derived, this information is transferred from the computer 214 to the electronic memory gauge 212. In the preferred embodiment, this transfer occurs before the memory gauge 212 is lowered into the well borehole 202. The transfer can occur in any suitable manner, such as either by connecting the electronic memory of the gauge 212 to the port 216 and actuating the computer 214 to electronically transfer the information from its memory into the memory of the gauge 212 or by loading the derived information into an EPROM within the computer 214 and then physically removing the EPROM from the computer 214 and inserting it into a suitable receptacle in the memory gauge 212.

Once this transfer has occurred, the memory gauge 212 is activated or energized in a manner as known to the art, such as by connecting the electronic circuits to the battery in the exemplary embodiment of the memory gauge 212.

Once activated, the memory gauge 212 is run into the borehole 202 and the phenomena are detected by the memory gauge 212 in a manner as known to the art. This data collection is performed at the sample rates and in the ratios and during the time intervals as provided by the method of the present invention.

At the end of the testing period, the memory gauge 212 is pulled out of the borehole 202. The data contents of the memory gauge 212 are then entered into the computer 214 in a manner as known to the art, such as through the port 216, for analysis by the computer in a manner as known to the art.

In addition to transferring the time interval, sample rate and ratio information to the memory gauge 212 for thereafter controlling the operation of the memory gauge 212, the information derived by the method of the present invention can be printed from the computer 214 via the printer 222. The printout can be scaled in either absolute time or real time.

FIG. 4 is an illustration of an absolute time printout 296. The printout 296 shows the minimum and maximum time lines spaced parallel to each other. In between these two lines the boundaries of the time intervals and the associated sample rates and pressure-to-temperature ratios are specified. Although not shown in FIG. 4 for purposes of simplicity, the printout 296 can also include designations representing the events and other information as desired.

The absolute time printout 296 shown in FIG. 4 indicates that the first time interval, which is designated by the reference numeral 268 in FIG. 3, commences at the absolute start time and continues until 12 hours later. During this first time interval, no samples are to be taken of either pressure or temperature.

The second time interval, designated by the reference numeral 270 in FIG. 3, extends from 12 hours to 17 hours. During this time interval, samples are to be taken every 1 minute, 1.2 seconds (0.017 hours) with eleven pressure readings being recorded at this sample rate for every one temperature reading recorded.

The third time interval, which is designated by the reference numeral 272 in FIG. 3, extends from 17 hours to 21 hours with a sample rate of 3 minutes (0.05 hours) and a pressure-to-temperature ratio of 3:1.

FIG. 4 also shows the other time interval boundary times and the associated sample rates and ratios. These other time intervals correspond to the time intervals 274–294 shown in FIG. 3.

FIG. 5 shows a printout 298 from the printer 222 which is similar to the one shown in FIG. 4 except that the printout 298 of FIG. 5 is scaled in real time. In the preferred embodiment, the real time is noted by the operator when the memory gauge 212 is activated prior to being lowered into the well borehole 202. This real time is correlated to the zero absolute start time shown in FIGS. 3 and 4. From this real time start time, the absolute times indicated in FIGS. 3 and 4 can be converted to the corresponding real times. For example, in FIG. 5 the real time noted at the start time was 13:23:21.00 on Sept. 20, 1984. Therefore, 12 hours later, the end of the first time interval 268 would be the 1:23:21.00 Sept. 21, 1984 reading specified in FIG. 5. The other times shown in FIG. 5 are similarly computed from the 13:23:21.00 Sept. 20, 1984 start time. The sample rates and pressure-to-temperature ratios are the same in FIG. 5 as those shown in FIG. 4.

By defining the minimum and maximum time periods as performed in the preferred embodiment of the present invention, a better estimate of when the actual event will occur can be derived. Additionally, selecting the fastest sample rate for an event which could be occurring at any particular time insures that an adequate quantity of information will be obtained. Furthermore, selecting the minimum ratio of samples of one phenomenon relative to another phenomenon insures that enough data of one phenomenon relative to the quantity of another will be obtained.

Although the preferred embodiment of the present invention has been described to be specifically useful with a Hewlett-Packard computer and a Geophysical Resources Corporation memory gauge to record pressure and temperature in a downhole environment, the present invention can be adapted for other uses and equipment. In the specific environment of oil and gas wells, the present invention is particularly useful for drill stem tests and hydrostatic pressure surveys. However, the present invention can be adapted for other uses.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

```
1168  %"*********  ******"
1169: % " HISTOGRAPH".
1170:
1171:
1172:
1173: "VPLOT":
1174: if p1#3;gto +3
1175: "ENTER GAUGE START DATE & TIME  "}K$;'Set-time'(P)}P}V;stime P
1176: fmt 1,f4.0,":",f2.0,":",f4.1
1177: aclr
1178: "Lease Owner:"}J$[1,12];% "set lables "
1179: "Lease Name:"}J$[34,45]
1180: "Date:"}J$[56,62]
1181: "Well No.:"}J$[74,82]
1182: "Test No.:"}J$[94,103]
1183: "Ticket No.:"}J$[118,129]
1184: aclr
1185: prt "Lease Owner :   ",J$[14,33];% "prints fields to be filled in"
1186: prt "Lease Name  :   ",J$[46,55]
1187: prt "Date        :   ",J$[63,73]
1188: prt "Well No.    :   ",J$[83,93]
1189: prt "Test No.    :   ",J$[104,117]
1190: prt "Ticket No.  :   ",J$[130,140];% "end of field printing"
1191:
1192: % "now enter values into fields; HEADER prts fields and values"
1193: if J$[130,140]#"            ";"Y"}Q$[1,1];gto +8
                          Lease
1194: ent "Enter the L   Owner's name:",J$[14,33];cll 'HEADER'
1195: ent "Enter the Lease Name:",J$[46,55];cll 'HEADER
1196: ent "Enter the Date DD MMM YYYY:",J$[63,73];cll 'HEADER'
1197: ent "Enter the Well No.:",J$[83,93];cll 'HEADER'
1198: ent "Enter the Test No.:",J$[104,117];cll 'HEADER'
1199: ent "Enter the Ticket No.:",J$[130,140];cll 'HEADER'
1200: "Y"}Q$[1,1]
1201: ent "Are the above entries correct? enter Y or N (default is Y) ",Q$[1,1]
1202: cap(Q$[1,1])}Q$[1,1]
1203: if Q$[1,1]="N";gto -9
1204:
1205:
1206:
1207:
1208:
1209: % "enter operations and times"
1210: aclr ;% "initilize counter register"
1211: wrt 16,"Operation   samp rate   min ET   max ET  P/T ratio"
1212: 1}p90}p89
1213: cll 'OPERATION1'(1)
1214: if D$[2]#"";val(D$[41,1])}p100;gto +30
1215:
```

```
1216:
1217:
1218:
1219: 0}p100;gto +8
1220: cll 'OPERATION1'(p100)
1221: if p90=1;gto +3
1222: if p89=1;gto +2
1223: if D$[p100+1]="";str(p100)}D$[41];gto +21
1224: ent "Is there another operation?  Enter Y or N (default is Y)",Q$
1225: cap(Q$)}Q$
1226: if Q$="N";str(p100)}D$[41];2}p89;"Y"}Q$;gto +18
1227: 1+p100}p100
1228: dsp "Operation is: (RIH, ICIP etc.) (",D$[p100],")"
1229: ent "",D$[p100]
1230: cll 'OPERATION1'(p100)
1231: dsp "Sample rate is: (xh, xxm, xxs) (",U$[p100],")"
1232: ent "",U$[p100]
1233: cll 'OPERATION1'(p100)
1234: dsp "MIN E.T. of operation is (HH:MM) (",E$[p100],")"
1235: ent "",E$[p100]
1236: cll 'OPERATION1'(p100)
1237: dsp "MAX E.T. of operation is (HH:MM) (",H$[p100],")"
1238: ent "",H$[p100]
1239: cll 'OPERATION1'(p100)
1240: dsp "PRESS. to TEMP. ratio is (#:#) (",V$[p100],")"
1241: ent "",V$[p100]
1242: "Y"}Q$[1]
1243: gto -23
1244: ent "Are the above entries correct? enter Y or N (default is Y) ",Q$[1]
1245: cap(Q$[1])}Q$[1]
1246: if Q$[1]="N";2}p90;gto -27
1247:
1248:
1249:
1250:
1251:
1252: 0}p110}p111}p112}p113}p114}p115}p116}p117}p118}p119}p120}p121
1253: for J=1 to p100
1254: len(E$[J])}p116;% "  minimum time "
1255: len(H$[J])}p110;% " maximum time "
1256: p110-3}p111;% " hours portion length of max time"
1257: p116-3}p117;% "  hours portion length of min time"
1258: p111+2}p112;% " beginning position for minutes of max time"
1259: p117+2}p118;% " beginning position for minutes of min time"
1260: val(H$[J,1,p111])+p113}p113;% " sumation of hours portion of max times"
1261: val(E$[J,1,p117])+p119}p119;% " sumation of hours portion of min times"
1262: val(H$[J,p112,p110])+p114}p114;% "sumation of minutes part of max times"
1263: val(E$[J,p118,p116])+p120}p120;% "sumation of munutes part of min times"
1264: int((p113+p114/60)*1000)}p135
1265: if p135-int(p135)>=.5;1+p135}p135
1266: int(p135)/1000}E[J+1,1];% "puts dec hours in E,1 array for max times"
1267: int((p119+p120/60)*1000)}p135
1268: if p135-int(p135)>=.5;1+p135}p135
1269: int(p135)/1000}E[J+1,2];% " puts dec hours in E,2 array for min times"
1270:
1271: % "put sample rates in E,3 array"
1272: len(U$[J,1])}p130
```

```
1273: cap(U$[J,p130,p130])}U$[J,p130,p130]
1274: if U$[J,p130,p130]="H";val(U$[J,1,p130-1])*1000}E[J,3]
1275: if U$[J,p130,p130]="M";val(U$[J,1,p130-1])*1000/60}E[J,3]
1276: if U$[J,p130,p130]="S";val(U$[J,1,p130-1])*10/36}E[J,3]
1277: E[J,3]}p135
1278: if p135=0;gto +3
1279: if p135-int(p135)>.5;1+p135}p135
1280: if int(p135)=0;1}p135
1281: int(p135)/1000}E[J,3]
1282:
1283: % "sets up press in E,4 and temp in E,5 arrays"
1284: pos(V$[J,1],":")}p140
1285: val(V$[J,1,p140-1])}E[J,4]
1286: val(V$[J,p140+1,len(V$[J,1])])}E[J,5]
1287:
1288:
1289: next J
1290:
1291: % "clear out previous values of intv times samp rates and ratios"
1292: for J=1 to 20
1293: for I=1 to 5
1294: 0}B[J,I]
1295: next I
1296: next J
1297:
1298: E[1,3]}B[1,2];E[2,2]}B[1,1]}I;% "     sets first intv time & SR inB[]"
1299: if B[1,2]=0;gto +2
1300: int(B[1,1]/B[1,2])}B[1,5];% "        puts # samp in first intv in B[]"
1301: E[1,4]}B[1,3];E[1,5]}B[1,4];% "              sets first intv T/P ratio"
1302:
1303: 0}p89;1}p140}p131;2}p132;% "                      init control registers"
1304: E[2,3]}p157;E[2,4]}p158;E[2,5]}p159;% "      init SR sorting registers"
1305:
1306: p131+1}p131;p132+1}p132;% "            incr crtl reg for recalling info"
1307: if B[p140,2]=0;gto +2
1308: int(B[p140,1]/B[p140,2])}B[p140,5];% "      puts # samp in intv in B[]"
1309: p140+1}p140;% "                       incr crtl reg to set up data array"
1310: 65.536}p161;255}p162;0}p163;% "               init SR sorting registers"
1311: I+p89}p89
1312: if p131=val(D$[41,1])+2;prt " p131=",p131;gto +78
1313: if p132=val(D$[41,1])+2;p132-1}p132;gto +4
1314:
1315: if E[p132,2]<E[p131,1];gto +6;% "     is min time pt <  max time pt?"
1316: % "                              using max per end pt time for time pt"
1317: 1}p134;% "                        indicator when using max per time pt"
1318: p131}p133;% "                     put max per TP  array number in p133"
1319: p133-1}p151;gto +4;% "                  init max per side loop counter"
1320: % "                    using min per end pt time for time pt"
1321: 2}p134;% "                        indicator when using min per time pt"
1322: p132}p133;0}p151;% "init loop ctr, put min per TP array numb in p133"
1323: E[p133,p134]}Q
1324: Q-p89}I;% "                          I = time pt - previous time pt"
1325:
1326: 1+p151}p151;% "                                  increment loop counter"
1327: if p134=1;gto +29;% "                   trans if time pt is on max side"
1328:
1329: % "..................................... working with min side TPs"
```

```
1330: E[p133,1]-E[p133,2]}E;% "                    E = min period delta time"
1331: Q+E}p141;% "        p141 = time value  ahead that SRs will be checked"
1332: % "         find max side time period that spans this min side time pt"
1333: if Q>=E[p151,1] and Q<E[p151+1,1];gto +10
1334: % "          find max side TPs that are btwn min TP and min TP + delta"
1335: if E[p151,1]>=Q and E[p151,1]<p141;gto +8
1336: if Q=p141-E and Q+E=E[p151,1];gto +7
1337: % "                            kick out of loop when out of time points"
1338: if E[p151+1,2]=0;gto +34
1339: % "                end loop if min per TP + delta is < next max per TP"
1340: if p141<=E[p151,1];gto +32
1341: % "                                            loop for next max side TP"
1342: gto -16
1343: E[p151,3]}p135;% "             p135 = SR that is ocurring @ min per TP"
1344: if p135=0;65.536}p135;% "                                  0 = infinite SR"
1345:
1346: p135}p164
1347: E[p151,4]}p165
1348: E[p151,5]}p166
1349:
1350: if p161>p164;p164}p161;p165}p162;p166}p163;gto -24
1351: if p161<p164;gto -25
1352: min(p165,p162)}p162
1353: min(p166,p163)}p163
1354: gto -28
1355:
1356: % "..................................... working with max side TPs"
1357: E[p133,2]-E[p133,1]}E;% "                      E = -max per delta time"
1358: Q+E}p141;% "        p141 = time value behind that SRs will be checked"
1359: if E[p151+1,2]=0;1+p131}p131;gto +14;% "t spans this max side time pt"
1360:
1361:
1362: % "               find min side time period that spans this max side TP"
1363: if Q>E[p151,2] and Q<=E[p151+1,2];gto -20
1364: % "           find min side TPs that are btwn max TP and min TP - delta"
1365: if E[p151,2]<Q and E[p151,2]>=p141;gto -22
1366: % "                      end if min per TP + delta is < next max per TP"
1367: if p141<=E[p151,2];gto +5
1368: % ifp131=val(D$[41,1]);prt " p131=",p131;gto +4
1369: gto -43;% "                                    loop for next max side TP"
1370:
1371:
1372: if p134=1;p132-1}p132;gto +2
1373: p131-1}p131
1374: if p157=65.536;0}p157
1375: p157}B[p140,2];p158}B[p140,3];p159}B[p140,4]
1376:
1377: % "        check if latest SR = preceeding SR in B[]"
1378: if p157≠B[p140-1,2];1}B[p140,1];gto +7
1379:
1380: B[p140-1,1]+1}B[p140-1,1]
1381: min(p158,B[p140-1,3])}B[p140-1,3]
1382: max(p159,B[p140-1,4])}B[p140-1,4]
1383: p140-1}p140
1384:
1385: p161}p157
1386: p162}p158
1387: p163}p159
```

```
1388: gto -82
1389:
1390: cll 'display output select'
1391:
1392: aclr ;gclr
1393: psc S
1394: pen;pen# 1
1395: E[p100+1,1]/50}p121
1396: if p121<1.5;1}p121;gto +5
1397: if p121<3.5;2}p121;gto +4
1398: if p121<7.5;5}p121;gto +3
1399: if p121<15;10}p121;gto +2
1400: 20}p121
1401: E[p100+1,1]/p121}p115
1402: (int(p115)+1)*p121}p115
1403: scl -p115,0,0,1000
1404: csiz 1.1;pen
1405: plt -p115*.98,60;% " moves pen to start position for title block"
1406: lbl J$[1,73]
1407: plt -p115*.98,25
1408: lbl J$[74,140]
1409: % "draws block around plot title"
1410: plt -p115,80,-2;iplt .63*p115,0;iplt 0,-60;iplt -.63*p115,0;iplt 0,60
1411:
1412:
1413: pen;% "raise pen"
1414: csiz 1.1,2,1,270
1415: plt -.01*p115,250
1416: if p1=3;gto +2
1417: lbl "Minimum Elapsed Time";gto +2
1418: lbl "Minimum Time Schedule"
1419: plt -.01*p115,1000
1420: if p1=3;gto +2
1421: lbl "Maximum Elapsed Time";gto +4
1422: lbl "Maximum Time Schedule"
1423:
1424:
1425: pen# 2
1426: xax 300,p121,-p115,0;% " draws minimum time line with tic marks"
1427: xax 700,p121,-p115,0;% " draws maximum time line with tic marks"
1428: % xax600;% " draws time line for intv time display w/o tics"
1429:
1430:
1431: for J=0 to p115 by p121*5
1432: pen
1433: plt -J,710,-2;iplt 0,-20;% "extends tic marks for ends of operations"
1434: pen
1435: plt -J,290,-2;iplt 0,20;% "extends tic marks for ends of operations"
1436: next J
1437:
1438: 0}p99}p98
1439: p99+1}p99;if B[p99,1]=0;gto +6
1440: pen;B[p99,1]+p98}p98
1441: plt -p98,690,-2;iplt 0,20;gto -2
1442:
1443:
1444: % "print interval elapsed or real time along middle time line"
1445: csiz .85,2,1,270
```

```
1446: pen;pen# 1
1447: plt -.01*p115,690
1448: if p1=2;gto +2;% "if no real time jump"
1449: "Real time,"}S$;% " prints 'Real time' in heading";gto +2
1450: "Elapsed time,"}S$;% " prints 'Elapsed time' in heading"
1451: lbl S$
1452: "sample rate, # P, # T "}S$;% " center col heading"
1453: plt -.01*p115,530
1454: lbl S$
1455: 0}p99}p98
1456: p99+1}p99;% " increment counter"
1457: if B[p99,1]=0;gto +24
1458: if p99=21;gto +23
1459: pen
1460: B[p99,1]+p98}p98
1461: % cll'MTIME'(B[p99,2])
1462: % A$&", "&str(B[p99,3])&", "&str(B[p99,4])}S$
1463: plt -p98,690,1
1464: if p1=2;gto +4
1465: p98*3600+V}P
1466: cll 'Read-time'(P)
1467: lbl T$;gto +4
1468: fmt 1,f4.0,":",f2.0,":",f4.1
1469: lbl 'MTIME'(p98)
1470: plt -p98,580,1
1471: fmt 1,f4.0,":",f2.0,":",f4.1
1472: lbl 'MTIME'(B[p99,2]);fxd 0
1473: ","&str(B[p99,3])&","&str(B[p99,4])}S$
1474: plt -p98,390,1
1475: lbl S$
1476: lbl char(13),char(10)
1477: gto -21
1478:
1479:
1480:
1481: csiz 1.1,2,1,270
1482: % "print operation and time along min time line"
1483: for J=2 to p100+1
1484: pen;pen# 1
1485: plt -E[J,1],270,-2;iplt 0,30
1486: pen
1487: if J=2;plt -E[J,1]/2,150,1;gto +2
1488: plt (-E[J,1]-E[J-1,1])/2,150,1
1489: lbl D$[J-1,1]
1490: plt -E[J,1],270,1
1491: % " date = T$[len(T$)-13]  "
1492: % gto+2;% " comment this line out to get real time  labeled "
1493: if V>2^25;gto +2
1494: fmt 1,f4.0,":",f2.0;lbl 'MTIME'(E[J,1]);gto +2
1495: cll 'Read-time'(E[J,1]*3600+V);T$[1,len(T$)-13]}T$;lbl T$
1496: next J
1497:
1498:
1499: % "print operation and time along max time line"
1500: pen;pen# 1
1501: for J=2 to p100+1
1502: pen
1503: plt -E[J,1],730,-2;iplt 0,-30
```

```
1504: pen
1505: if J=1;plt -E[J,1]/2,900,1;gto +2
1506: plt (-E[J,1]-E[J-1,1])/2,900,1
1507: lbl D$[J-1,1]
1508: pen
                                                    time
1510: % gto+2;% " comment this line out to get real ~~tm~~   labeled "
1511: if V>2^25;gto +2
1512: fmt 1,f4.0,":",f2.0;lbl 'MTIME'(E[J,1]);gto +2
1513: cll 'Read-time'(E[J,1]*3600+V);T$[1,len(T$)-13]+T$;lbl T$
1514: next J
1515: if S≠16;gclr;gto +3
1516: dsp "press [CONTINUE]";stp
1517: gclr
1518: ret
```

What is claimed is:

1. A method of recording in a memory device at least one phenomenon detected during a series of events, comprising:

entering into a computer time information for defining a set of first time periods during which it is anticipated each of the events might occur and for defining a set of second time periods during which it is anticipated each of the events might occur so that for each event there is defined a respective one of said first time periods and a respective one of said second time periods, said set of first time periods different from said set of second time periods;

entering into said computer a series of sample rates, each of said sample rates associated with both a respective one of said first time periods and a respective one of said second time periods, both said respective one of said first time periods and said respective one of said second time periods pertaining to the same one of the events;

computing in said computer a series of contiguous time intervals so that each of said time intervals includes at least a portion of at least one of the first and second time periods defined for a respective one of the events whereby each of said time intervals pertains to at least one of the events and so that each of said time intervals has associated therewith the fastest one, and only the fastest one, of the sample rates associated with the ones of the first and second time periods defined for the events to which the time interval pertains when the time interval pertains to more than one of the events;

transferring said series of contiguous time intervals and the sample rates associated with said time intervals to said memory device; and activating said memory device for recording said at least one phenomenon during said time intervals at the sample rates associated with said time intervals.

2. The method of claim 1, wherein:

each of said first time periods is contiguous with any immediately preceding one and any immediately succeeding one of said first time periods; and each of said second time periods is contiguous with any immediately preceding one and any immediately succeeding one of said second time periods.

3. The method of claim 2, wherein:

each of said first time periods represents an anticipated initial period during which a respective one of the events might occur; and each of said second time periods represents an anticipated final period during which a respective one of the events might occur.

4. The method of claim 1, wherein:

each of said first time periods represents an anticipated initial period during which a respective one of the events might occur; and each of said second time periods represents an anticipated final period during which a respective one of the events might occur.

5. The method of claim 1, further comprising:

measuring said time intervals from a start time;

detecting a real time at which said step of activating commenced; and correlating said start time with said real time.

6. The method of claim 1, wherein said step of computing includes:

defining, in response to said time information, a start time for each respective first time period;

defining, in response to said time information, a start time for each respective second time period;

defining, in response to said time information, an end time for each respective first time period;

defining, in response to said time information, an end time for each respective second time period;

assigning each sample rate associated with a respective first time period and a corresponding respective second time period to each time increment between and including the start time of the respective first time period and the end time of the respective second time period;

at each start time for each respective first time period, comparing all the sample rates assigned to that start time and selecting the fastest sample rate assigned thereto;

at each start time for each respective second time period, comparing all the sample rates assigned to that start time and selecting the fastest sample rate assigned thereto;

at each end time for each respective first time period, comparing all the sample rates assigned to that end time and selecting the fastest sample rate assigned thereto;

at each end time for each respective second time period, comparing all the sample rates assigned to that end time and selecting the fastest sample rate assigned thereto; and detecting all consecutively occurring selected sample rates having the same value and thereby defining one of said time intervals between the one of the start time for a first time period, the start time for a second time period, the end time for a first time period, or the end time for a second time period at which the same-valued, consecutively occurring selected sample rates commence and the one of said start time for a first time period, the start time for a second time period, the end time for a first time period and the end time for a second time period at which the same-valued, consecutively occurring selected sample rates end.

7. The method of claim 6, wherein:

the end time of one of said first time periods coincides with the start time of a next one of said first time periods; and the end time of one of said second time periods coincides with the start time of a next one of said second time periods.

8. The method of claim 1, wherein:

said method further comprises entering into said computer a series of ratios in which said at least one phenomenon is to be sampled relative to at least one other phenomenon, each of said sample ratios associated with a respective one of said first time periods and a respective one of said second time periods; and said step of computing includes selecting for each of said time intervals the minimum one, and only the minimum one, of the ratios associated with those portions of said first and second time periods included within the respective time interval.

9. A method of programming a means for recording at least one detected phenomenon occurring during a series of events, said means including data storage means for receiving a series of time intervals during which the at least one detected phenomenon is to be recorded and for receiving a series of sample rates defining the frequencies at which the at least one detected phenomenon is to be recorded, said method comprising:

defining a series of minimum time periods from a start time, each of said minimum time periods representing an anticipated initial period during which a respective one of the events might occur;

defining a series of maximum time periods from said start time, each of said maximum time periods representing an anticipated final period during which a respective one of the events might occur;

associating each initial period with the corresponding final period during which the same respective one of the events might occur so that a respective time segment is defined therebetween;

assigning a sample rate to each time segment;

deriving from said series of minimum time periods, said series of maximum time periods, and each said sample rate a single series of time intervals, each of said time intervals including at least a portion of at least one of said time segments and each of said time intervals having associated therewith the fastest sample rate of those sample rates assigned to each time segment having at least a portion thereof included within the respective time interval; and entering said single series of time intervals and the associated sample rates in said data storage means.

10. The method of claim 9, further comprising:

assigning to each time segment a ratio in which at least two detected phenomena are to be detected;

selecting for each time interval the smallest ratio of those ratios assigned to each time segment having at least a portion thereof included within the respective time interval; and entering the selected ratios in said data storage means.

11. A method of recording in an electronic memory device pressure and temperature detected during a plurality of events occurring in a well, comprising:

defining a first time sequence during which the plurality of events might occur, said first time sequence including a plurality of sequential first time periods, each of said first time periods representing a respective period within said first time sequence during which a respective one of the events might occur;

defining a second time sequence, different from said first time sequence, during which the plurality of events might occur, said second time sequence including a plurality of sequential second time periods, each of said second time periods representing a respective period within said second time sequence during which a respective one of the events might occur;

assigning a sample rate to each pair of said first time periods and said second time periods corresponding to the same one of the events so that a plurality of sample rates is defined in correspondence with said plurality of events, each of said sample rates defining the frequency at which at least one of said pressure and temperature is desired to be recorded during the respective time period;

deriving from said plurality of sequential first time periods, said plurality of sequential second time periods, and said plurality of sample rates a single set of time intervals having a respective sample rate associated with each one of said time intervals;

entering said single set of time intervals and each respective sample rate in said electronic memory device;

activating said electronic memory device;

lowering said electronic memory device into said well; and recording in said electronic memory device at least one of said pressure and temperature in response to the respective sample rate within each of said time intervals.

12. The method of claim 11, wherein:

said method further comprises:

assigning a pressure-to-temperature sample ratio to each of said first time periods and each of said second time periods corresponding to the same one of the events so that a plurality of pressure-to-temperature sample ratios is defined in correpondence with said plurality of events;

associating a respective one of said plurality of pressure-to-temperature sample ratios with each one of said time intervals; and entering each of said associated respective one of said plurality of pressure-to-temperature sample ratios in said electronic memory device; and said step of recording includes recording said pressure and temperature at the respective sample rate and in the respective pressure-to-temperature sample ratio within each of said time intervals.

13. The method of claim 12, wherein:

said step of deriving includes:

defining each of said time intervals so that it pertains to at least one of the events by including the same time covered by at least a portion of at least one of the first time periods and the second time periods corresponding to the same said at least one of the events to which the time interval pertains; and selecting said respective sample rate so that it is the fastest of the sample rates assigned to all the pairs of the first and second time periods having at least portions thereof included within the respective one of said time intervals; and said step of associating includes selecting the minimum pressure-to-temperature sample ratio of those sample ratios assigned to all the pairs of the first and second time periods having at least portions thereof included within the respective one of said time intervals.

14. The method of claim 13, wherein:

each of said first time periods is an estimated minimum time period during which the respective one of the events might occur; and each of said second time periods is an estimated maximum time period during which the respective one of the events might occur.

15. The method of claim 14, further comprising measuring said time intervals from the time of activating said memory device.

16. The method of claim 11, wherein:

each of said first time periods is an estimated minimum time period during which the respective one of the events might occur; and each of said second time periods is an estimated maximum time period during which the respective one of the events might occur.

17. The method of claim 16, wherein said step of deriving includes:

defining each of said time intervals so that it pertains to at least one of the events by including the same time covered by at least a portion of at least one of the first time periods and the second time periods corresponding to the same said at least one of the events to which the time interval pertains; and selecting said respective sample rate so that it is the fastest of the sample rates assigned to all the pairs of the first and second time periods having at least a portion thereof included within the respective one of said time intervals.

18. The method of claim 11, wherein said step of deriving includes:

for at least one selected time within each of said first time periods and said second time periods, comparing all the same rates for those of said plurality of events which could be occurring at the selected time and selecting the fastest one of the compared sample rates; and grouping consecutively occurring ones of the selected sample rates having the same value to define one of said time intervals for each group of the consecutively occurring, same-valued sample rates.

19. The method of claim 18, wherein:

said method further comprises:

assigning a pressure-to-temperature sample ratio to each of said first time periods and each of said second time periods corresponding to the same one of the events so that a plurality of pressure-to-temperature sample ratios is defined in correspondence with said plurality of events;

associating a respective one of said plurality of pressure-to-temperature sample ratios with each one of said time intervals; and entering each of said associated respective one of said plurality of pressure-to-temperature sample ratios in said electronic memory device; and said step of recording includes recording said pressure and temperature at the respective sample rate and in the respective pressure-to-temperature sample ratio within each of said time intervals.

20. The method of developing a sample rate schedule, in accordance with which schedule a detected phenomenon, occurring during a series of events, is to be sampled, said method comprising:

defining a series of minimum time periods from a start time, each of said minimum time periods representing an anticipated initial period during which a respective one of the events might occur;

defining a series of maximum time periods from said start time, each of said maximum time periods representing an anticipated final period during which a respective one of the events might occur;

associating each initial period with the corresponding final period during which the same respective one of the events might occur so that a respective time segment is defined therebetween;

assigning a sample rate to each time segment; and deriving from said series of minimum time periods, said series of maximum time periods, and each said sample rate a single series of time intervals, each of said time intervals including at least a portion of at least one of said time segments and each of said time intervals having associated therewith the fastest sample rate of those sample rates assigned to each time segment having at least a portion thereof included within the respective time interval.

* * * * *